US010555572B2

(12) United States Patent
Diakonov

(10) Patent No.: US 10,555,572 B2
(45) Date of Patent: Feb. 11, 2020

(54) ATHLETIC GARMENT WITH POCKETS

(71) Applicant: ON'RE SPORT, LTD., Macomb, MI (US)

(72) Inventor: Dmitri Diakonov, Macomb, MI (US)

(73) Assignee: ON'RE SPORT, LTD, Grosse Pointe Farms, MI (US)

( * ) Notice: Subject to any disclaimer, the term of this patent is extended or adjusted under 35 U.S.C. 154(b) by 12 days.

(21) Appl. No.: 15/746,074

(22) PCT Filed: Jul. 21, 2016

(86) PCT No.: PCT/US2016/043395
§ 371 (c)(1),
(2) Date: Jan. 19, 2018

(87) PCT Pub. No.: WO2017/015492
PCT Pub. Date: Jan. 26, 2017

(65) Prior Publication Data

US 2018/0206567 A1 Jul. 26, 2018

Related U.S. Application Data

(60) Provisional application No. 62/195,171, filed on Jul. 21, 2015.

(51) Int. Cl.
*A41D 27/20* (2006.01)
*A41D 1/08* (2018.01)
(Continued)

(52) U.S. Cl.
CPC ..... *A41D 27/207* (2013.01); *A41D 1/08* (2013.01); *A41D 1/089* (2018.01); *A41D 1/14* (2013.01);
(Continued)

(58) Field of Classification Search
CPC ..... A41D 27/207; A41D 1/089; A41D 1/08; A41D 1/14; A41D 13/0012; A41D 13/0015; A41D 27/205; A41F 9/00; A63B 47/001
(Continued)

(56) References Cited

U.S. PATENT DOCUMENTS 1,912,327 A 5/1933 Vaccaro
2,291,414 A 7/1942 Slobotkin
(Continued)

OTHER PUBLICATIONS

"BMG Women's Fold Over Waist Slimming Ankle Leggings Workout tight Yoga Pants." First comment: Jan. 31, 2014. Amazon. http://www.amazon.com/Stretchy-Fitted-Foldover-Workout-Legging/dp/B00HVWC7S8.

(Continued)

*Primary Examiner* — Gloria M Hale
(74) *Attorney, Agent, or Firm* — Dority & Manning, P.A.

(57) ABSTRACT

An athletic garment comprising an envelope pocket positioned along an upper portion of the garment and configured to secure objects is disclosed. The envelope pocket may be comprised of a compression material that may secure stored objects in place. In one embodiment, an envelope pocket may be opened from the bottom and disposed along the rear, upper portion of the garment. The pocket opening may be positioned such that an athlete may reach around his or her back and quickly and ergonomically insert and retrieve balls from the pocket. The envelope pocket may be constructed such that the stored objects and balls do not impede an athlete's movement during athletic activity.

20 Claims, 15 Drawing Sheets

(51) Int. Cl.

| | |
|---|---|
| ***A41F 9/00*** | (2006.01) |
| ***A63B 47/00*** | (2006.01) |
| ***A41D 13/00*** | (2006.01) |
| ***A41D 1/089*** | (2018.01) |
| ***A41D 1/14*** | (2006.01) |
| *A63B 102/02* | (2015.01) |

(52) U.S. Cl.
CPC ..... *A41D 13/0012* (2013.01); *A41D 13/0015* (2013.01); *A41D 27/205* (2013.01); *A41F 9/00* (2013.01); *A63B 47/001* (2013.01); *A41D 2300/50* (2013.01); *A41D 2400/48* (2013.01); *A63B 2102/02* (2015.10)

(58) Field of Classification Search
USPC ..... 2/247, 227, 228, 238
See application file for complete search history.

(56) References Cited

U.S. PATENT DOCUMENTS

| | | | | |
|---|---|---|---|---|
| 2,412,622 | A | 12/1946 | Koppelman | |
| 2,508,190 | A | 5/1950 | Previdi | |
| 2,607,934 | A | 8/1952 | Bailhe | |
| 3,320,620 | A | 5/1967 | Weidler et al. | |
| 3,744,059 | A | 7/1973 | Hayes | |
| 3,813,697 | A | 6/1974 | Belpaume | |
| 3,871,030 | A * | 3/1975 | Green | A63B 47/001 2/238 |
| 3,968,522 | A | 7/1976 | Riess | |
| 4,079,871 | A * | 3/1978 | Sica | A45C 11/00 224/677 |
| 4,301,549 | A | 11/1981 | Ingram | |
| 4,413,762 | A | 11/1983 | Carini | |
| 4,416,404 | A | 11/1983 | Daniels | |
| 4,428,080 | A | 1/1984 | Takamatsu | |
| 4,433,803 | A * | 2/1984 | Liberboim | A63B 47/001 224/251 |
| 4,498,200 | A | 2/1985 | Livingstone | |
| 4,513,455 | A | 4/1985 | Gerhardt | |
| 4,603,441 | A | 8/1986 | Richter | |
| 4,625,336 | A | 12/1986 | Derderian | |
| 4,920,577 | A | 5/1990 | Scharf | |
| 4,958,386 | A | 9/1990 | Louis-Jeune | |
| 5,064,107 | A | 11/1991 | Ascarrunz | |
| 5,182,815 | A * | 2/1993 | Young | A41B 9/004 2/228 |
| 5,517,696 | A | 5/1996 | Krugler | |
| 5,636,386 | A | 6/1997 | Salamone | |
| 5,724,679 | A * | 3/1998 | Hans | A41D 1/08 2/228 |
| D404,889 | S | 2/1999 | Fujii et al. | |
| 5,870,777 | A * | 2/1999 | Hans | A41D 1/08 2/228 |
| 6,006,363 | A | 12/1999 | Karlin | |
| D420,781 | S | 2/2000 | Fujii et al. | |
| 6,148,443 | A | 11/2000 | Maastricht | |
| D461,943 | S | 8/2002 | Lyden | |
| D465,315 | S | 11/2002 | Tanaka | |
| D465,900 | S | 11/2002 | Tanaka | |
| D473,694 | S | 4/2003 | Lyden | |
| D481,523 | S | 11/2003 | Hujii et al. | |
| D483,551 | S | 12/2003 | Kallen | |
| 6,993,940 | B2 * | 2/2006 | Rabinowicz | A41D 13/0015 2/250 |
| 7,500,274 | B1 | 3/2009 | Kallen | |
| 7,516,498 | B2 | 4/2009 | Torry | |
| 7,559,093 | B2 | 7/2009 | Sudo et al. | |
| D613,037 | S | 4/2010 | Iamartino et al. | |
| 7,730,552 | B2 | 6/2010 | Ota et al. | |
| D619,330 | S | 7/2010 | Peters | |
| D632,461 | S | 2/2011 | Morii et al. | |
| D641,135 | S | 7/2011 | Zarabi | |
| 8,028,345 | B2 * | 10/2011 | Waite | A41D 1/14 2/69 |
| D654,661 | S | 2/2012 | Savage | |
| D673,756 | S | 1/2013 | Agnew et al. | |
| D681,916 | S | 5/2013 | Tanaka et al. | |
| D683,522 | S | 6/2013 | Pasloski | |
| D686,799 | S | 7/2013 | Farina et al. | |
| 9,021,615 | B2 | 5/2015 | Cockram | |
| D730,624 | S | 6/2015 | Prpic et al. | |
| D731,753 | S | 6/2015 | Mahtani | |
| D741,572 | S | 10/2015 | Bickley et al. | |
| D742,095 | S | 11/2015 | Savage | |
| D743,144 | S | 11/2015 | Swan | |
| D750,346 | S | 3/2016 | McManus | |
| 2009/0300818 | A1 * | 12/2009 | Waite | A41D 1/14 2/76 |
| 2012/0030864 | A1 | 2/2012 | Marois et al. | |
| 2013/0305433 | A1 | 11/2013 | Hedrick | |
| 2014/0143936 | A1 * | 5/2014 | Flanagan | A41F 9/02 2/247 |
| 2014/0196194 | A1 | 7/2014 | Clarke et al. | |
| 2014/0231277 | A1 | 8/2014 | Ponski | |
| 2014/0274475 | A1 | 9/2014 | Little et al. | |
| 2015/0074871 | A1 | 3/2015 | Emich et al. | |
| 2015/0128331 | A1 * | 5/2015 | Grosse | A41D 13/0017 2/400 |
| 2015/0359273 | A1 | 12/2015 | Olson | |
| 2016/0088887 | A1 | 3/2016 | Cockram | |

OTHER PUBLICATIONS

"Nike Legend 2.0 Tight Fold-over Waistband." First comment: May 26, 2015. Nike. http://store.nike.com/us/en_us/pd/legend-2-tight-fold-over-waistband-training-capris/pid-10337803/pgid-10926496.

* cited by examiner

ATHLETIC GARMENT WITH POCKETS

CROSS-REFERENCE TO RELATED APPLICATION

This application claims priority to U.S. Provisional Patent Application No. 62/195,171 filed on Jul. 21, 2015, which is hereby incorporated by reference in its entirety.

BACKGROUND

Athletes frequently have the need to store balls and other objects within their clothing during athletic activities and sporting events. In tennis, for example, a player may wish to store an extra ball for future use in the event the player misses his or her first service attempt or hits the ball into an inconvenient area of the court. Access to a readily available ball may allow for the match to continue seamlessly. Athletes may wish to store other types of objects as well. Runners, bikers, and yoga practitioners may wish to store portable electronic devices for playing music, GPS tracking, or for functioning as a timer or stopwatch.

In the past, athletes, especially racquet sport athletes, have stored balls and other objects within their clothing in a number of different locations, including but not limited to: front-thigh pockets, under compression clothing along the side of the leg, hip, and/or lower buttocks, and in elastic bands disposed about the waist. Many times athletes struggle to insert or retrieve objects from these areas and sometimes an athlete may inadvertently expose body parts not intended to be exposed when inserting or retrieving an object from the stowage location. Moreover, sometimes these locations impair the movement of an athlete, especially in tennis and other racquet sports where a player's swing path may be compromised by inadvertently brushing or bumping into a stored object. Additionally, bands and waistbands may slip out of position during play or when an athlete goes to insert or retrieve an object for use. This slippage can be very distracting to an athlete when engaged in a competitive game or match.

Thus, there is a need for an athletic garment that addresses these noted challenges.

SUMMARY

An athletic garment having an envelope pocket comprised of a compression material and being disposed along an upper portion of the garment such that an athlete may quickly and ergonomically insert and retrieve objects from the pocket as well as securely and comfortably store the objects in place without impeding the athlete's movement is disclosed.

In one embodiment, an athletic garment may have an envelope pocket integrated into the upper portion of the garment such that an athlete may quickly and ergonomically insert and retrieve objects from the pocket. The envelope pocket may be enclosed on its sides and top portion and may be configured to open from the bottom or near the bottom of the pocket. In particular, the pocket opening may be positioned at the bottom portion of the pocket which is generally located at the base of the upper portion of the garment. In this manner, an object, such as a tennis ball, may be inserted upward into the envelope pocket and the compression material of the pocket may secure the ball in place by compressing the ball against a reactive surface, or in this case, a player's upper buttocks/lower back region. Advantageously, a ball and/or other objects may be secured in place even during aggressive or strenuous athletic activities. Multiple envelope pockets may provide for many objects to be stowed.

In another embodiment, an athletic garment may comprise of dual envelope pockets positioned along the rear upper portion of the garment. The pocket openings may be at the bottom of the pockets. The first envelope pocket may have a width defined by a first seam located generally at the side of the garment and a second seam centered in the rear of the garment. The second envelope pocket may have a width defined by the second seam and a third seam located generally at the side of the garment opposite the first seam. In this manner the pockets may be disposed along the rear, upper portion of the garment. The pockets may each be of a height sufficient to secure one or more tennis balls.

In another embodiment, an athletic garment may have an envelope pocket being constructed with an outer panel and inner panel. The outer panel and inner panel may extend upward from a bottom portion of the pocket. The inner panel may extend upward and then may be folded over at a top seam. The inner panel may then extend slightly downward and may meet with the outer panel at a joining panel seam along an inner waist portion of the garment. The top portion of the inner panel may be free standing, or an uncoupled inner top portion, as it may not be attached or joined with outer panel at this top portion location. The outer panel may extend upward from the bottom portion and may join with inner panel at a joining panel seam positioned along the inner waist portion of the garment. The outer panel may then extend and fold over the uncoupled top portion of the inner panel. The outer panel may then extend downward back toward the bottom portion. The outer panel is not joined or attached with the garment at the bottom portion of the outer waist portion of the garment, as this is the location of the pocket opening. The uncoupled top portion of the inner panel may allow for lateral flexibility in the pocket cavity and may allow for an object to be inserted upward and inward toward a more laterally sloping natural curve of an athlete's body (i.e., the upper ridge of an athlete's buttocks where it intersects the lower back). The fold over portion of the outer panel allows for the outer panel to extend not only the height of the outer waist portion, but may allow for the outer panel to extend along the height of the inner waist portion of the garment. In this manner, more surface area of the outer panel is placed under tension when an object is inserted into the pocket cavity, thereby increasing the compressive forces on the stored object. Greater compressive forces, properly applied to the object, may allow for the pocket to more securely hold an object.

In yet another embodiment, an athletic garment may comprise of an envelope pocket and a horizontal envelope pocket for storing various objects, such as portable electronic devices. The horizontal envelope pocket may comprise a vertical opening or may be opened from the bottom and may contain a flap panel that may further secure the device in place.

DETAILED DESCRIPTION

Multiple embodiments of an athletic garment are described with reference to the drawings, wherein like numerals reference like structures. Although an athletic garment may be illustrated and described herein as including particular components in a particular configuration, the components and configuration shown and described are provided for example purposes only. The figures and descriptions of the embodiments described herein are not intended to limit the breadth or the scope of the inventive concepts or the appended claims in any manner. Rather, the figures and detailed descriptions of the various embodiments are provided to illustrate the inventive concepts to a person of ordinary skill in the art and to enable such person to make and use the inventive concepts.

It will be appreciated that the terms "athlete" and "player" are used for explanatory purposes only and that the exemplary athletic garments described herein are not limited to athletes and players. Moreover, the exemplary athletic garments need not be used for athletic activities or sporting events; rather, they may be worn for any purpose.

Figure 1:
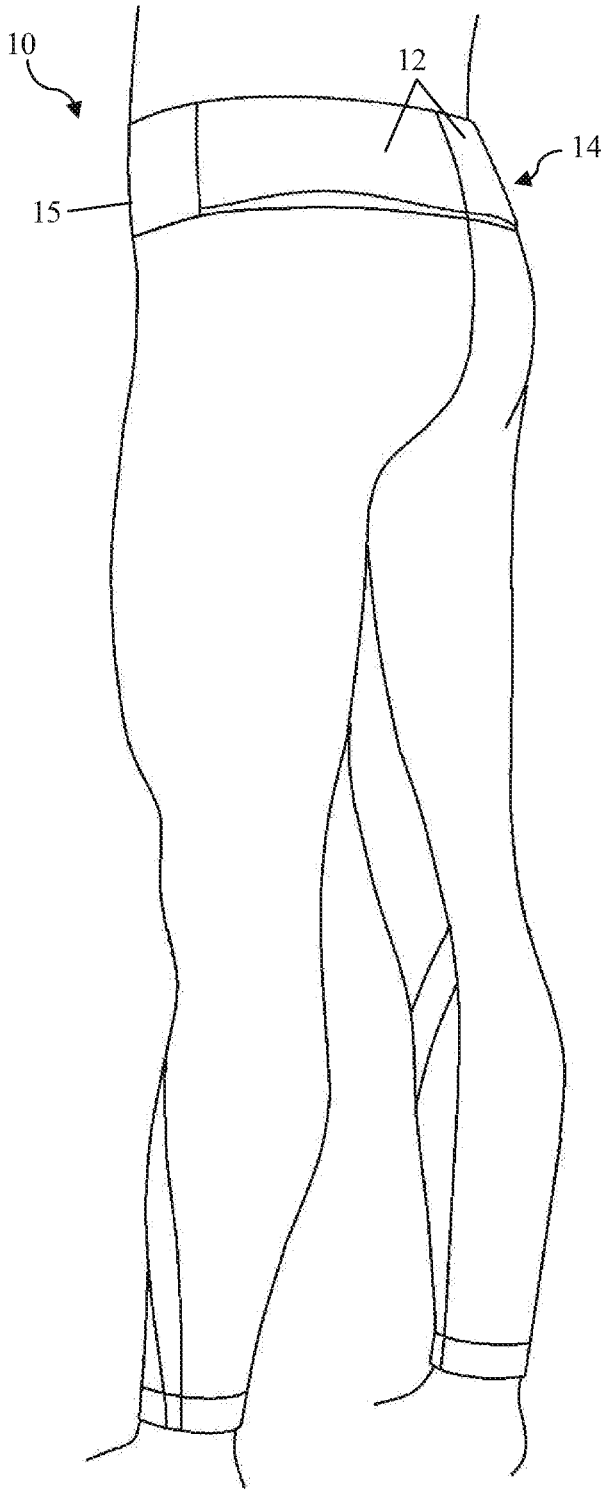
FIG. 1 is a rear perspective view of an exemplary athletic garment.
Figure 2:
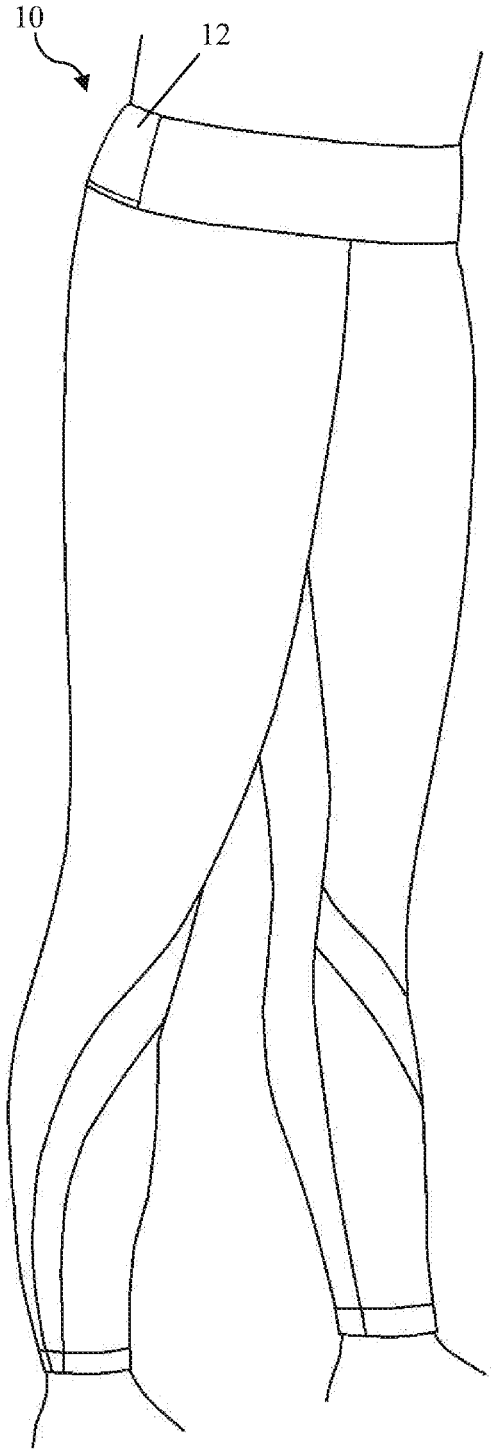
FIG. 2 is a front perspective view of an exemplary athletic garment.

Turning now to the drawings, FIG. 1 depicts a rear perspective view of an exemplary athletic garment 10 comprising dual envelope pockets 12. FIG. 2 illustrates a front, perspective view thereof. In this embodiment, athletic garment 10 is a compression pant having dual envelope pockets 12 disposed along an upper portion 14 of the garment. Generally, an upper portion 14 may be a circumferential portion of the athletic garment 10 that is configured to be disposed around the waistline region of a person when the garment is worn. The waistband portion 15 of the athletic garment 10 is shown being disposed along the upper portion 14 of the athletic garment 10.

The athletic garment 10 may comprise of a compression material (i.e., an elastic material). Common compression materials include but are not limited to spandex (Lycra®), polyester, nylon, other polypropylene fibers, and various blends of these noted materials. In one embodiment, an athletic garment 10 may be a warp knitted tricot, 4-way stretch, 250 GSM (Grams per Square Meter), 73% polyester/27% Lycra material. It will be appreciated that other types of knits, stretch fabrics, weights, and material blends are possible.

When compression pants are worn, the elastic material of the athletic garment is stretched, or placed in tension. The material seeks to return to its equilibrium state, effectively compressing an athlete's lower body encircled by the compression pants. In particular, the waistband portion 15 disposed about an upper portion 14 of the athletic garment 10 may be made of a compression material. And when an object is placed in an envelope pocket 12, the pocket material is stretched. The pocket material seeks to return to its equilibrium state, thereby compressing the object against the reactive surface, or in this case, the lower back/upper buttocks region of a person, which effectively secures the object in the pocket.

Figure 3:
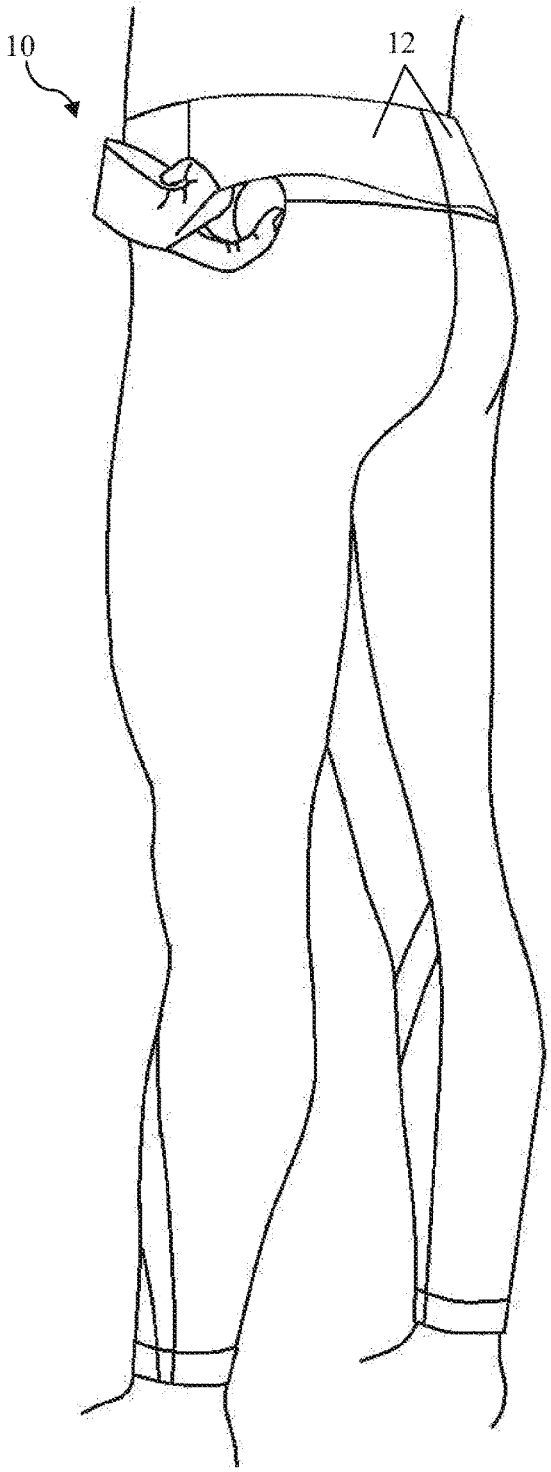
FIG. 3 is a rear perspective view of an exemplary athletic garment wherein an envelope pocket is shown in use.

Referring to FIG. 3, a rear, perspective view of an exemplary athletic garment 10 wherein an envelope pocket 12 is shown in use is illustrated. As shown, a player may reach around his or her back and quickly and ergonomically insert a tennis ball (or other object) into envelope pocket 12. A player may place and retrieve the ball from the envelope pocket 12 while maintaining a generally upright posture without need to bend or crunch over, as the pocket openings are disposed along an upper portion 14 of the athletic garment 10, an easy to reach location.

Figure 4:
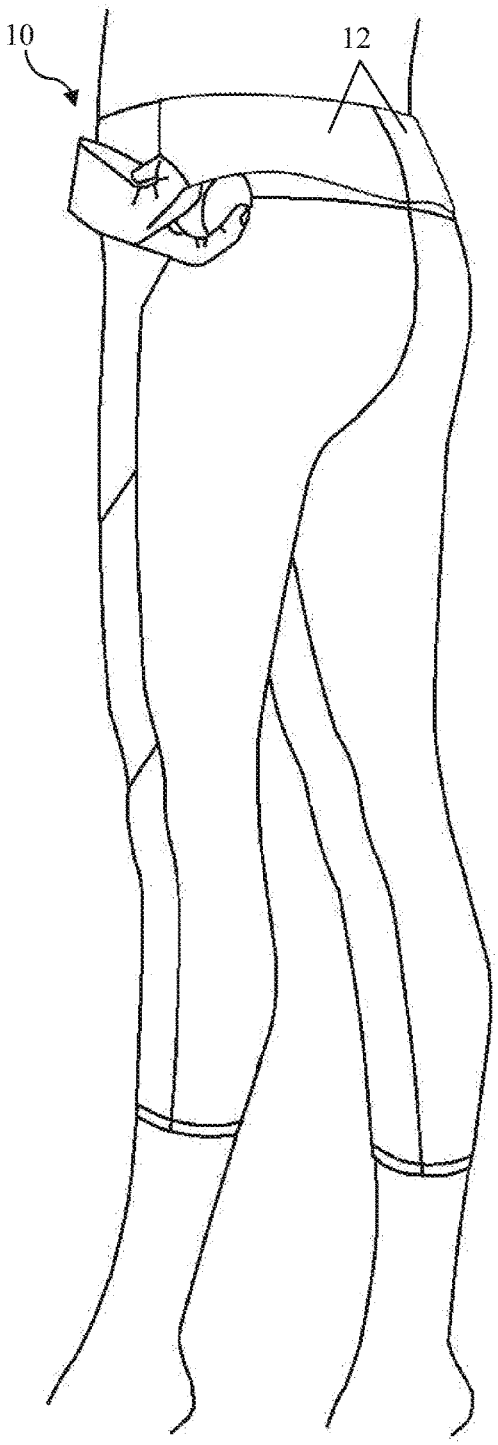
FIG. 4 is a rear perspective view of an exemplary athletic garment wherein an envelope pocket is shown in use.
Figure 5:
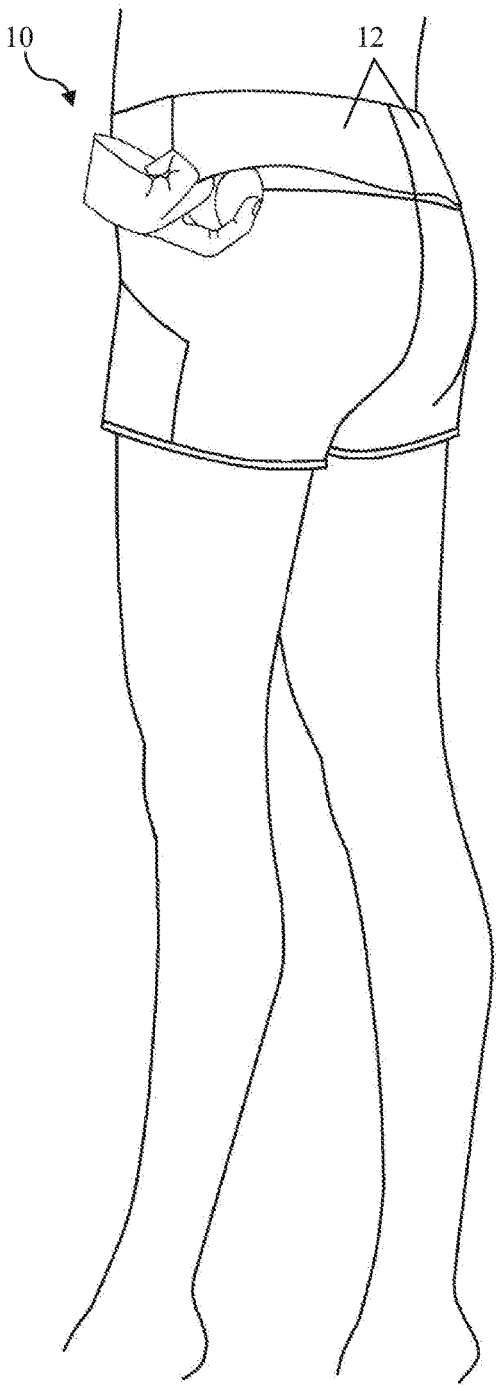
FIG. 5 is a rear perspective view of an exemplary athletic garment wherein an envelope pocket is shown in use.
Figure 6:
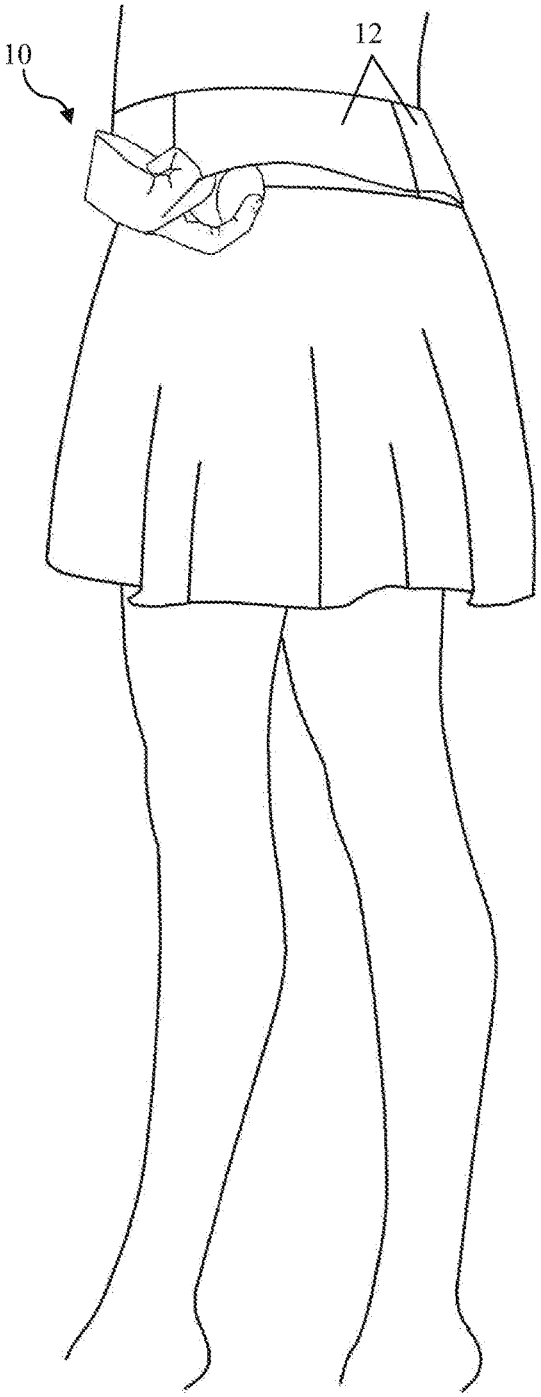
FIG. 6 is a rear perspective view of an exemplary athletic garment wherein an envelope pocket is shown in use.

Referring now to FIGS. 4, 5, and 6, various exemplary embodiments of athletic garments 10 are shown. In FIG. 4, athletic garment 10 is shown as a pair of capris embodying dual envelope pockets 12. In FIG. 5, athletic garment 10 is shown as a pair of shorts embodying dual envelope pockets 12. In FIG. 6, athletic garment 10 is shown as a skirt embodying dual envelope pockets 12. It will be appreciated that other embodiments of athletic garments comprising envelope pockets are possible.

Figure 7:
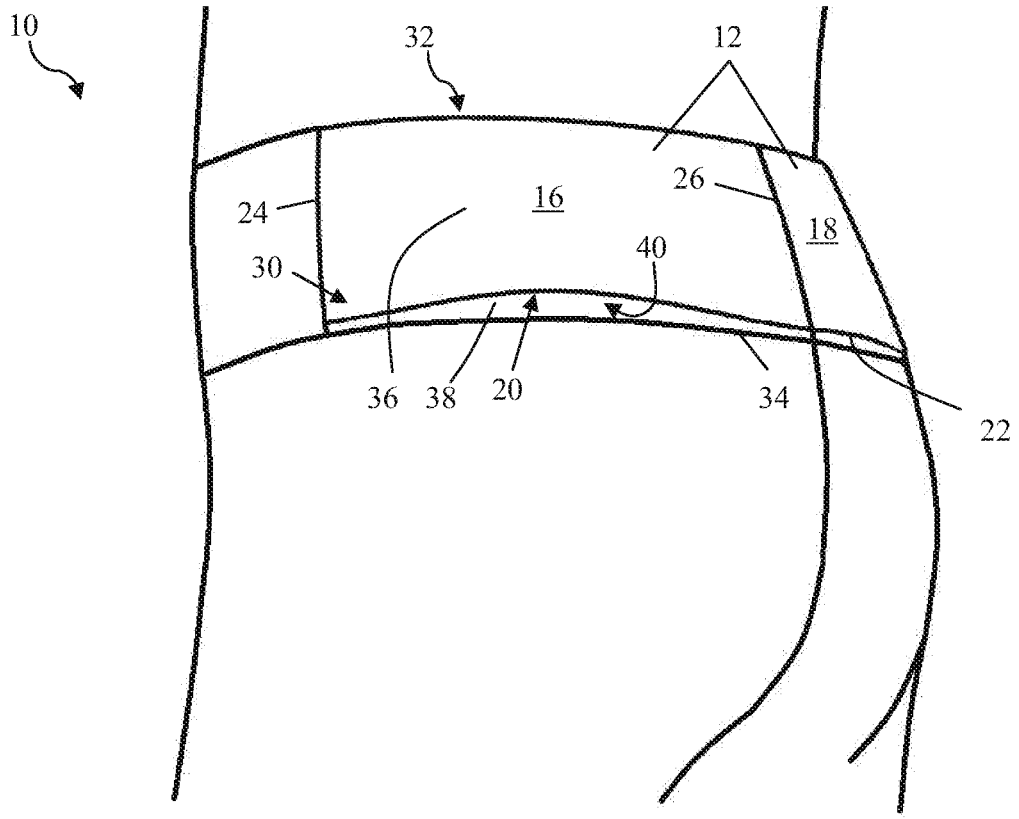
FIG. 7 is a close up, rear perspective view of an exemplary athletic garment comprising dual envelope pockets.
Figure 8:
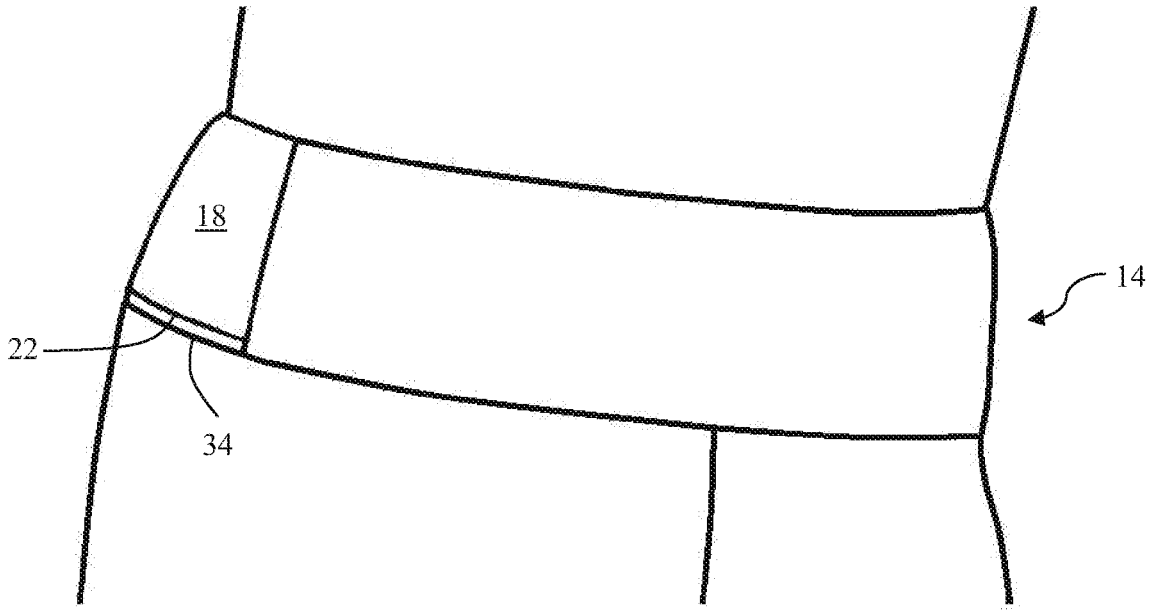
FIG. 8 is a close up, front perspective view of an exemplary athletic garment comprising dual envelope pockets.
Figure 9:
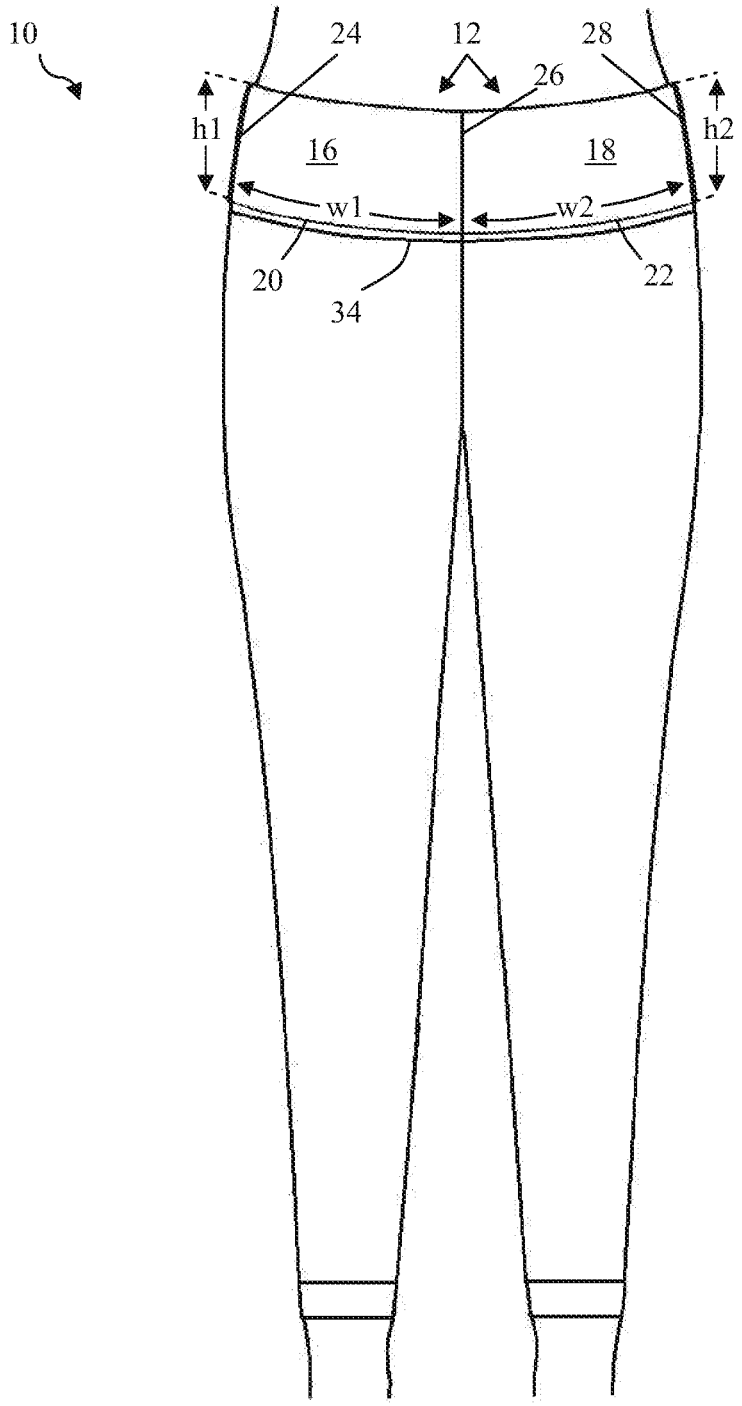
FIG. 9 is a rear view of an exemplary athletic garment.

With reference to FIGS. 7, 8, and 9, envelope pockets 12 of an exemplary athletic garment 10 will be described in more detail. An athletic garment 10 may comprise a first envelope pocket 16 and a second envelope pocket 18. The first envelope pocket 16 may be opened from the bottom at first opening 20, and likewise, second envelope pocket 18 may be opened from the bottom at second opening 22.

First envelope pocket 16 may have a width w1 defined by a first seam 24 and a second seam 26 and may have a height h1 defined by a bottom portion 30 and top portion 32. Second envelope pocket 18 may have a width w2 defined by second seam 26 and a third seam 28 and may have a height h2 defined by bottom portion 30 and top portion 32. Height h1 and height h2 may be of a sufficient height to accommodate a tennis ball or other specific object the envelope pockets 12 are intended to secure. The heights h1, h2 of the envelope pockets 12 may be of a length that may fully enclose a ball when it is inserted such that the ball is not visible when inserted into the pocket; or in an alternative embodiment, the ball may be partially visible after it is inserted. First envelope pocket 16 may be enclosed on its sides by first seam 24 and second seam 26 and by top portion 32. Similarly, second envelope pocket 18 may be enclosed on its sides by second seam 26 and third seam 28 and by top portion 32. In this manner, an outer panel 36 comprising of a compression material and an inner panel 38 of an envelope pocket 12 may form a pocket cavity 40 to secure an object within the pocket.

In one embodiment, first seam 24 may extend vertically from top portion 32 to bottom portion 30 and may be disposed along the side of the athletic garment 10 such that, when it is worn, the first seam 24 is disposed generally centered along a person's side or hip. First seam 24 may also be disposed exactly at the side of the garment. Likewise, third seam 28 may extend vertically from top portion 32 to bottom portion 30 and may be disposed along the side of the athletic garment 10 such that, when it is worn, the third seam 28 is disposed generally centered along a person's side or hip. The third seam 28 may be disposed on the opposite side or hip from the first seam 24. First seam 24 may also be disposed exactly at the side of the garment. Second seam 26 may extend vertically from top portion 32 to bottom portion 30 and may be disposed along the rear of the athletic garment 10 such that, when it is worn, the second seam 24 is disposed generally centered with a person's spine. The positioning of the seams 24, 26, 28 may allow for a person to quickly and ergonomically place a ball repeatedly in a comfortable position nestled along the upper buttocks/lower back region. The first and third seams 24, 28 may ensure that a player does not place a ball directly on the side of his or her hip, as this may impede movement, and in the case of racquet sports, it may impede or disrupt the swing path of a player. The positioning of the second seam 26, which is the center seam in this embodiment, may ensure that a player does not insert a tennis ball in the center of his or her back, as this may cause discomfort in reaching around to retrieve the ball and may also cause discomfort to a player's sacrum, lower lumbar, and tailbone areas. Moreover, the second seam 26 may prevent balls from sliding around from the left buttocks/lower back area to the right buttocks/lower back area.

Figure 17:
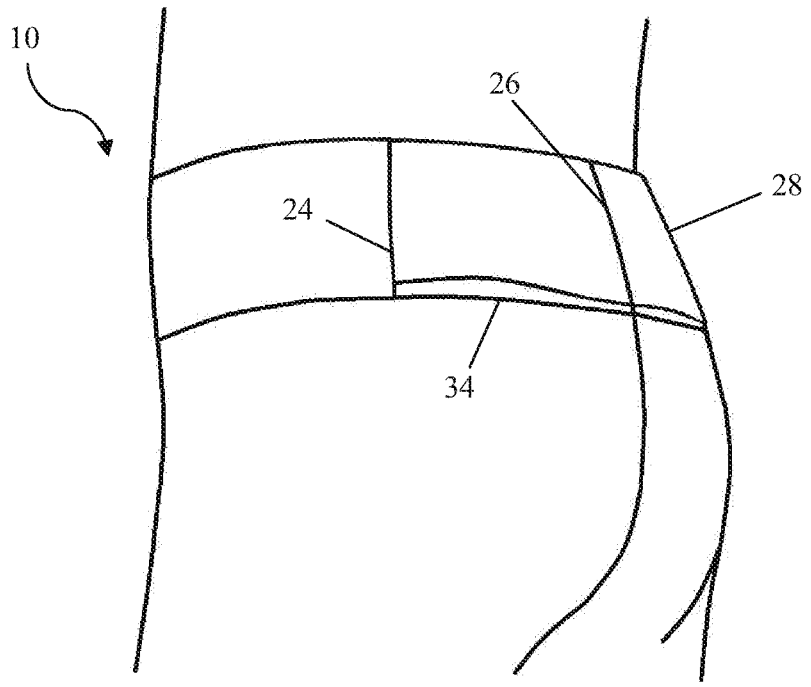
FIG. 17 is a close up, rear perspective view of an exemplary athletic garment comprising dual envelope pockets.
Figure 18:
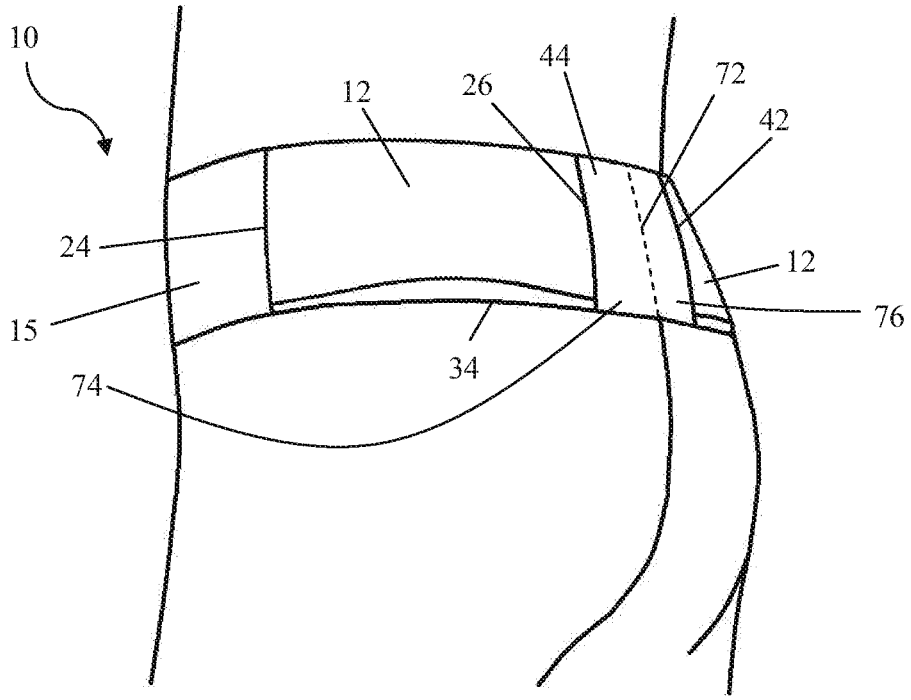
FIG. 18 is a close up, rear perspective view of an exemplary athletic garment comprising dual envelope pockets.

In another embodiment, first seam 24 and third seam 28 may each be positioned closer to the center of a person's back as shown in FIG. 17. This may allow for a player to ensure that an inserted ball or object is positioned more toward the center of the player's back. In another embodiment, as shown in FIG. 18, first seam 24 and third seam 28 (not shown) may be positioned generally along opposite sides of the athletic garment 10. However, the second seam 26 and a fourth seam 42 may define a center region 44 that does not include an envelope pocket 12. A rear centerline 72 splits the athletic garment 10 into a first side 74 and a second side 76. In this embodiment, the center region 44 may provide greater protection for a person's sacrum area and may ensure that balls and other objects are positioned more toward the sides of the athletic garment 10.

Figure 10:
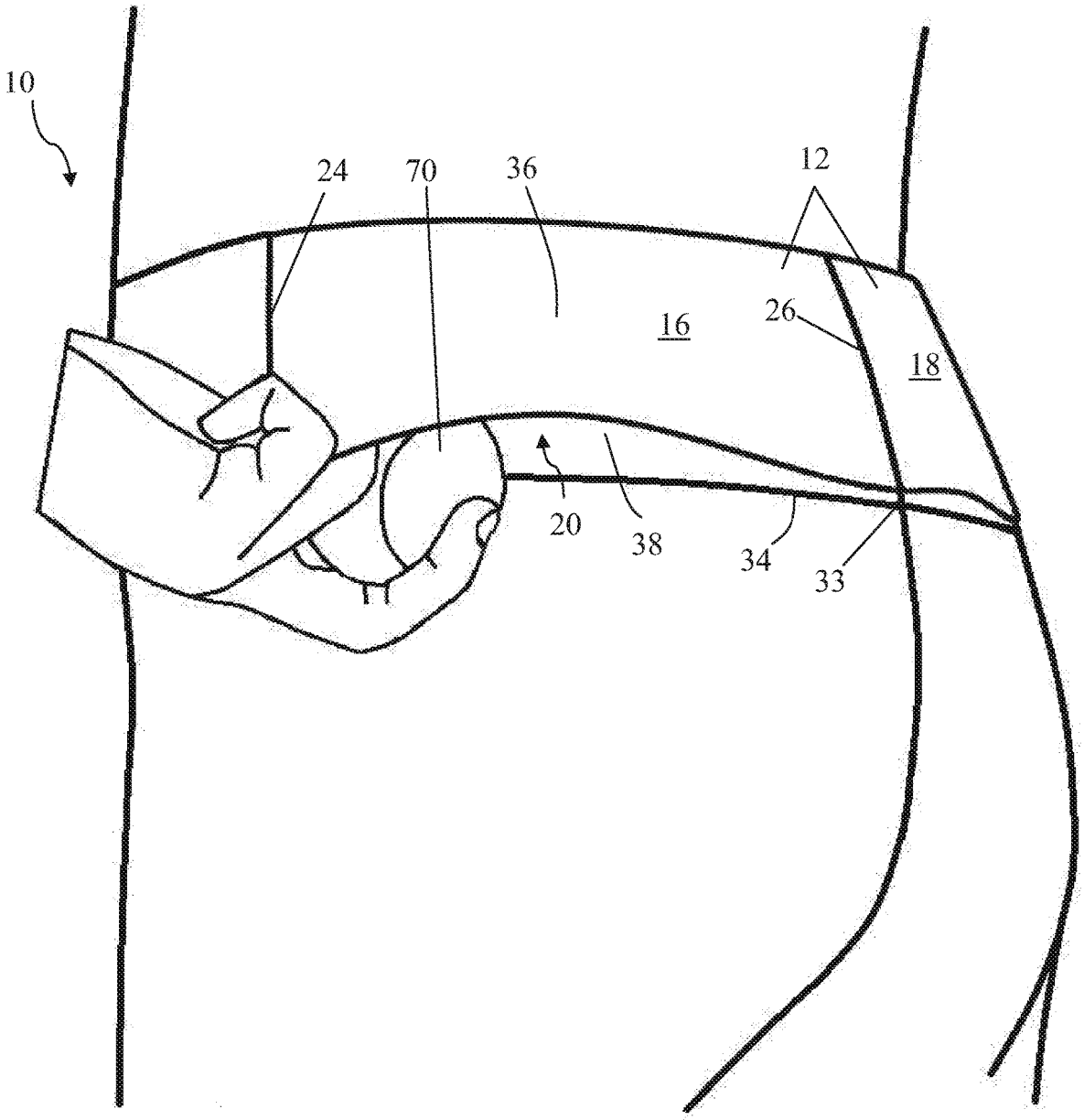
FIG. 10 is a close up, rear perspective view of an exemplary athletic garment wherein an envelope pocket is shown in use.

Referring to FIG. 10, a close up perspective view of an exemplary athletic garment 10 with an object being inserted into an envelope pocket 12 is illustrated. In this embodiment, a tennis ball 70 is being placed in the first envelope pocket 16. To insert the tennis ball 70, a player may locate the first envelope pocket 16 by sliding his or her fingers upward. Optionally, locating piping 34 may act as a locator for first opening 20 (and second opening 22 for second envelope pocket 18). Once the first opening 20 is located at the bottom portion 30 of the first envelope pocket 16, a player may use one finger to open the pocket and the others to push the tennis ball 70 upward into the pocket. Other methods of inserting an object into an envelope pocket 12 are also contemplated.

To remove a ball or object from an envelope pocket 12, a player may press downward on the ball with his or her thumb and catch the ball with his or her other fingers. Other methods of retrieving an object from an envelope pocket 12 are also contemplated. Athletic garment 10 may include a flat lock double seam 33 at the junction of the second seam 26 and locating piping 34. This may prevent the stitching of the pockets to suffer from failures, as this is a high wear area.

Referring now to FIGS. 11, 12, 13, and 14, various views of an exemplary athletic garment 10 having balls stowed within its dual envelope pockets 12 are shown. In these various embodiments, the width w1 of first envelope pocket 16 extends from the first seam 24 (located generally at the side of the athletic garment 10) to the second seam 26 (located generally in the middle of the rear portion of the athletic garment 10). Thus, first envelope pocket 16 is wide enough for a player to place one or more tennis balls in first envelope pocket 16. Second envelope pocket 18, being of a similar construction, may also have a width w2 that allows for a player to place multiple tennis balls into the pocket. Thus, a player may carry multiple objects within his or her dual envelope pockets 12.

Figure 11:
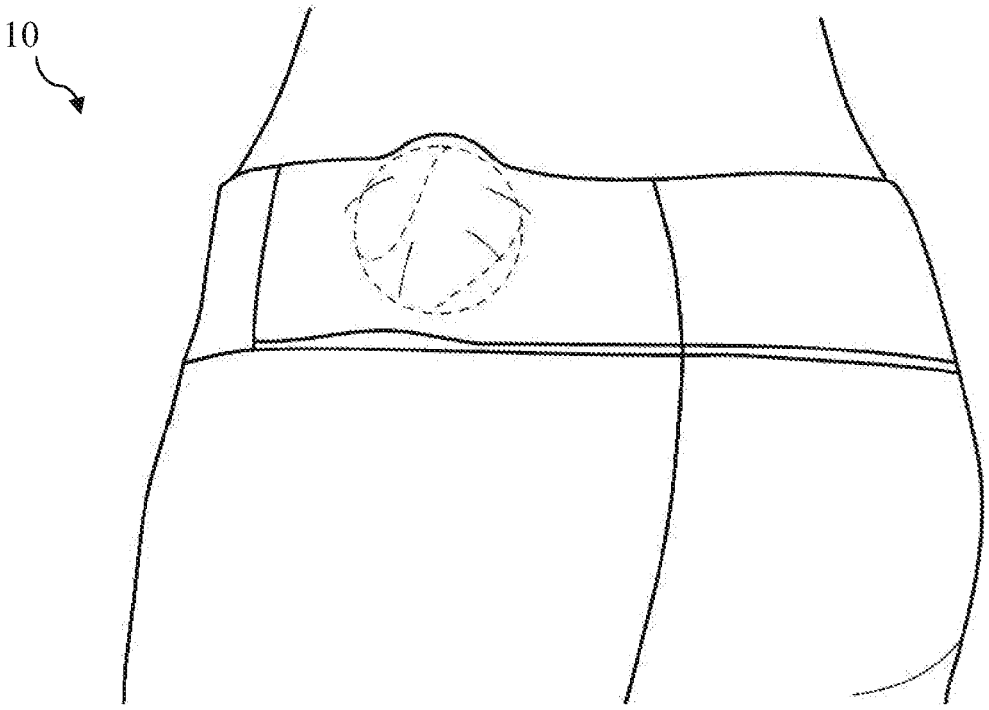
FIG. 11 is a close up, rear perspective view of an exemplary athletic garment wherein an object is stored within an envelope pocket.
Figure 12:
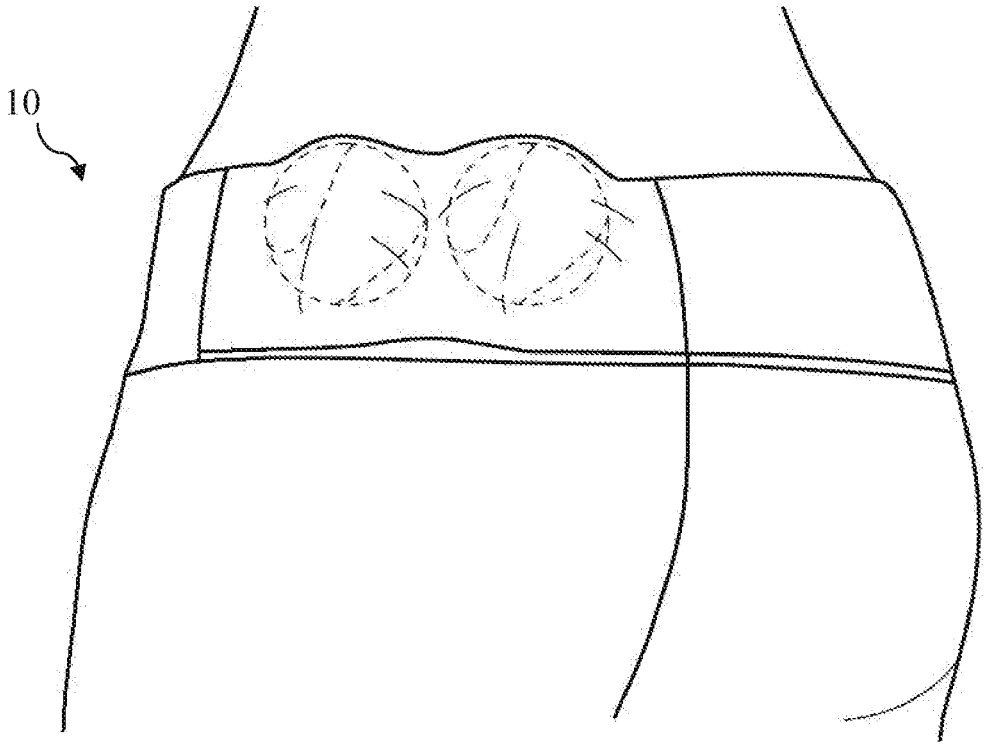
FIG. 12 is a close up, rear perspective view of an exemplary athletic garment wherein two objects are stored within an envelope pocket.
Figure 13:
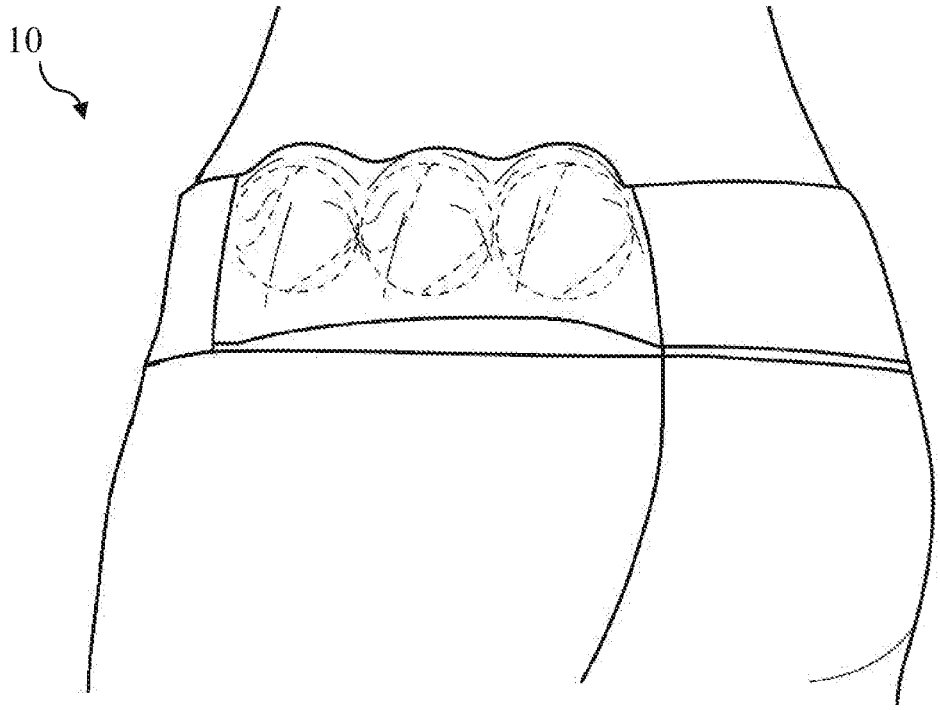
FIG. 13 is a close up, rear perspective view of an exemplary athletic garment wherein three objects are stored within an envelope pocket.
Figure 14:
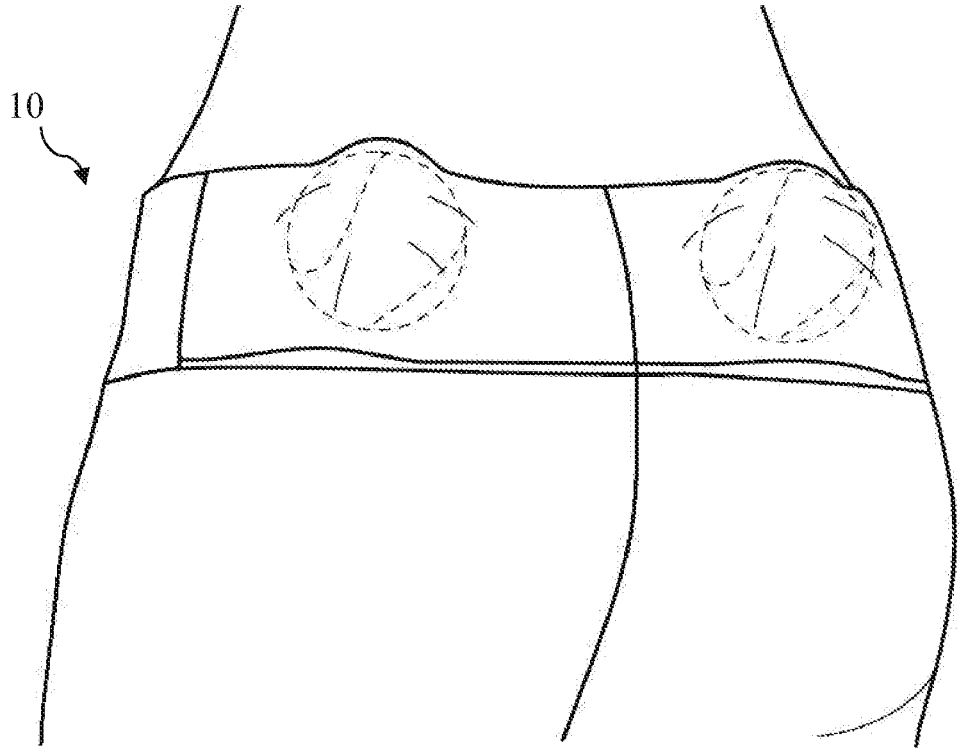
FIG. 14 is a close up, rear perspective view of an exemplary athletic garment wherein one object is stored within each envelope pocket.

In particular, FIG. 11 shows an athletic garment 10 having one tennis ball stowed in its first envelope pocket 16. FIG. 12 shows an athletic garment 10 having two tennis balls stowed in it first envelope pocket 16. FIG. 13 shows an athletic garment 10 having three tennis balls stowed in it first envelope pocket 16. FIG. 14 shows an athletic garment 10 having a tennis ball stowed in its first envelope pocket 16 and a tennis ball stowed in its second envelope pocket 18. It will be appreciated that in the embodiments shown that both the first and second envelope pockets 16, 18 may include up to three balls in their respective pockets.

Figure 15:
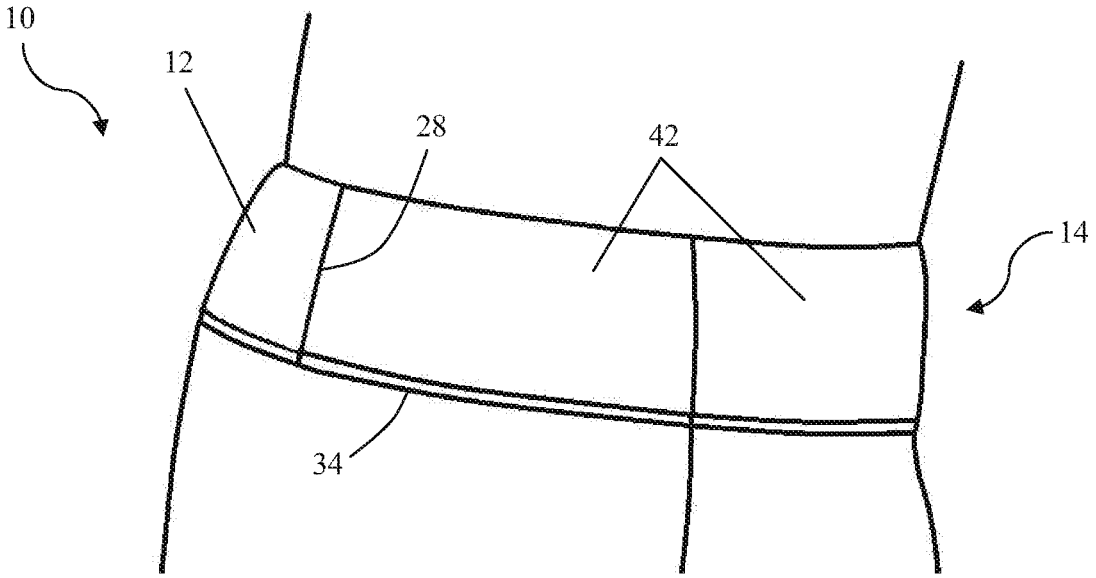
FIG. 15 is a close up, front perspective view of an exemplary athletic garment comprising dual-front envelope pockets.

Referring to FIG. 15, another embodiment of an athletic garment 10 is shown having envelope pockets 12 and front envelope pockets 42 disposed along the upper portion 14 of the garment. It will be appreciated that front envelope pockets 42 may be constructed and may secure objects in the same fashion as envelope pockets 12 disposed along the rear of athletic garment 10.

Figure 16:
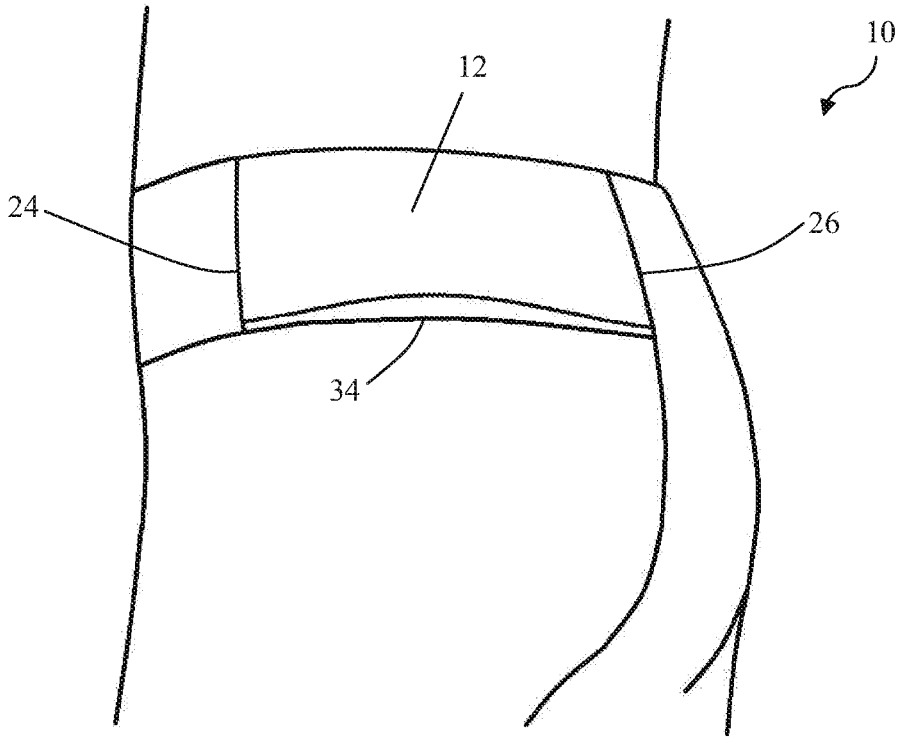
FIG. 16 is a close up, rear perspective view of an exemplary athletic garment comprising a single envelope pocket.

Referring to FIG. 16, another embodiment of an athletic garment 10 is shown having a single envelope pocket 12 disposed along the upper portion 14 of the garment. It will be appreciated that the single envelope pocket 12 depicted in FIG. 16 may be constructed and may secure objects in the same fashion as embodiments described having dual envelope pockets 12.

Figure 19:
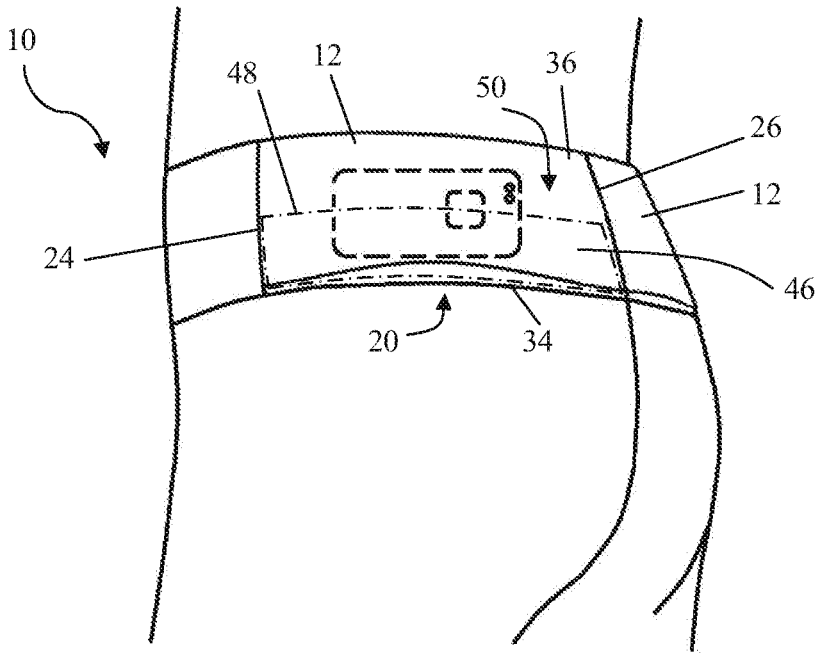
FIG. 19 is a close up, rear perspective view of an exemplary athletic garment having an envelope pocket with a flap panel.

Referring now to FIG. 19, an exemplary athletic garment 10 having an envelope pocket 12 with a flap panel 46 is illustrated. The outer panel 36 is transparent in FIG. 19 so that flap panel 46 (shown generally by the dot-dashed lines) may be visible. In this embodiment, personal items, such as a phone (shown with dashed lines), may be stored within envelope pocket 12 and may be further secured by flap panel 46. Flap panel 46 may be enclosed at its bottom portion by being stitched together with locating piping 34 and may be enclosed on its sides by first seam 24 and second seam 26. It will be appreciated that flap panel 46 is shown not extending to the seams and locating piping 34 for illustrative purposes and that flap panel 46 may indeed be stitched with these various seams and piping. Flap panel 46 may extend from the locating piping 34 to flap panel top portion 48.

Objects may be inserted into the flap pocket opening 50 in the following manner. An athlete may first slightly pull out outer panel 36 such that an object may be pushed up into the envelope pocket 12. Next, the athlete may pull out flap panel 46 such that the object may be pushed downward and into the flap pocket opening 50. Accordingly, aside from the compression afforded by the envelope pocket material, flap panel 46 may effectively further prevent an object from falling out of the envelope pocket 12.

Figure 20:
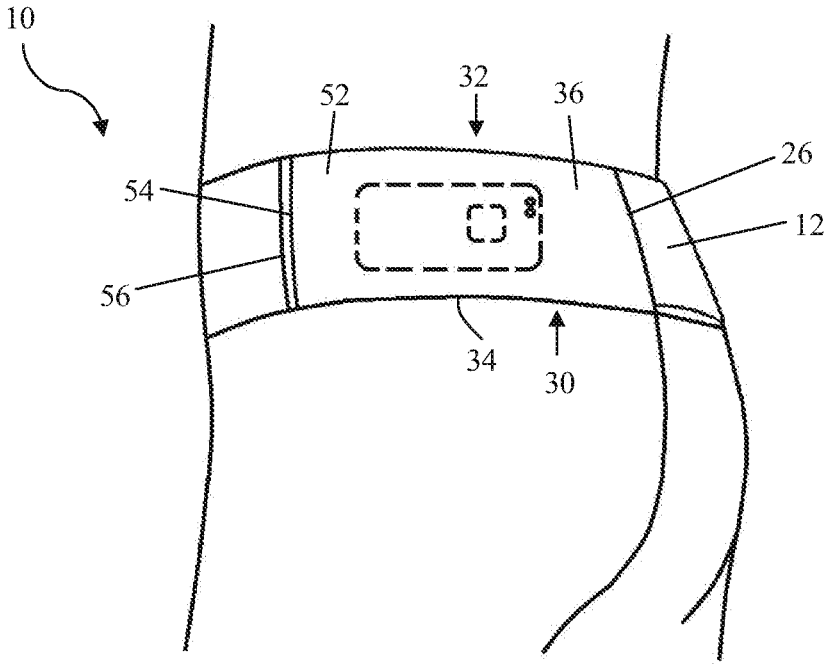
FIG. 20 is a close up, rear perspective view of an exemplary athletic garment having an envelope pocket with a side opening.

With reference to FIG. 20, a close up, rear perspective view of an exemplary athletic garment 10 having a horizontal envelope pocket 52 with a side opening 54 is shown. The outer panel 36 is transparent in FIG. 20 so that objects within the horizontal envelope pocket 52 may be visible. Horizontal envelope pocket 52 may be enclosed by top portion 32 at the top of the pocket, by locating piping 34 at the bottom portion 30 of the pocket, and on its side by second seam 26, which in this embodiment is centered along the rear of the garment. Side opening 54 may allow for objects, in this case a phone, to be inserted and retrieved from the horizontal envelope pocket 52. Optionally, vertical piping 56 may assist the athlete with locating side opening 54.

Figure 21:
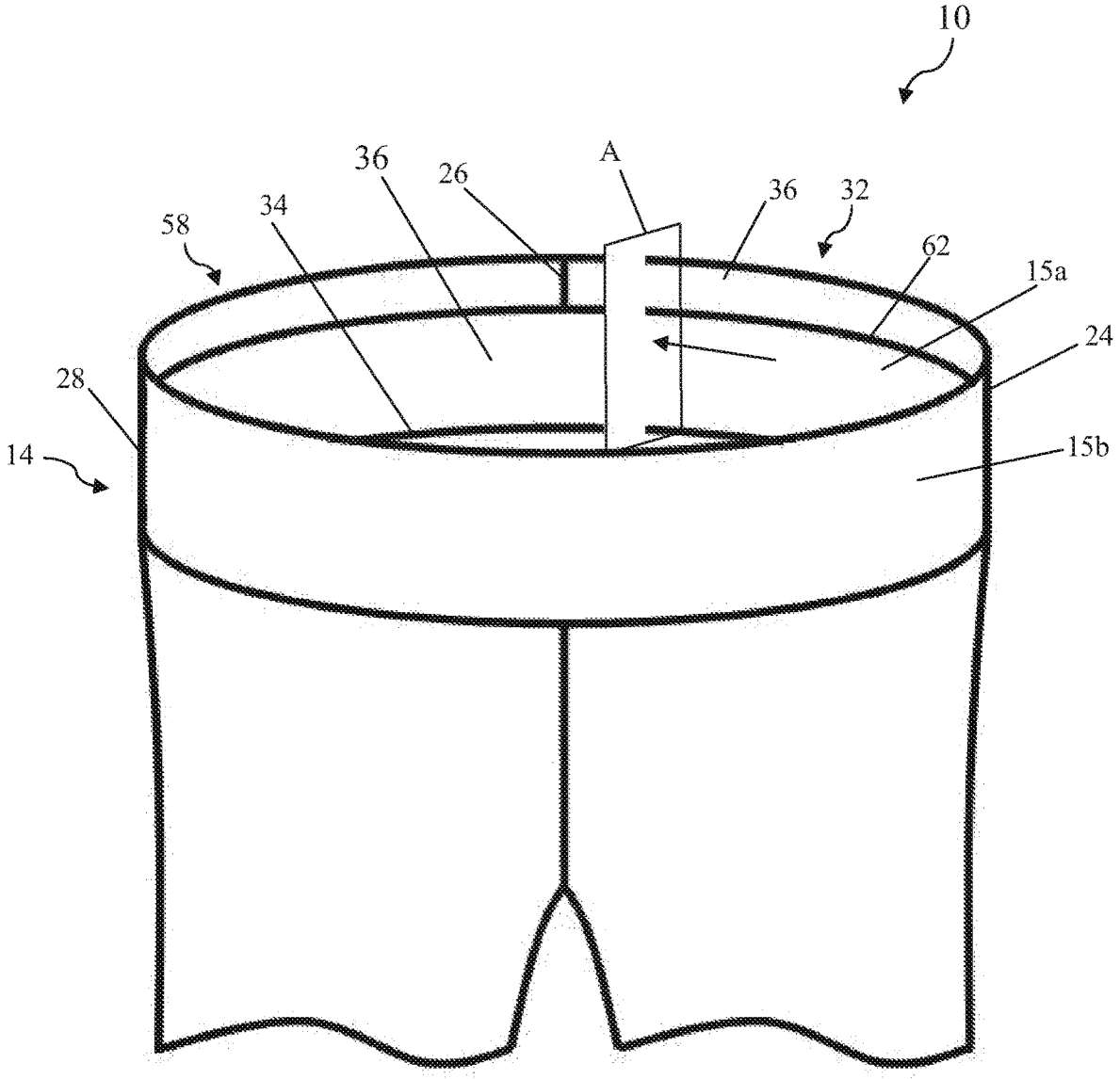
FIG. 21 is a front, perspective view of an exemplary athletic garment detailing the inner, rear waistband.

With reference to FIG. 21, the construction of an envelope pocket 12 of an exemplary athletic garment 10 will be described in more detail. FIG. 21 is a front, perspective view of an exemplary athletic garment 10 detailing the inner, rear waistband, or inner waist portion 15*a*. Notably, outer panel 36 may comprise a fold over portion 58 that folds over the inner panel 38 at the top portion 32 of the garment. Second seam 26 also folds over top portion 32 as shown. Outer panel 36 may be joined with inner panel 38 at joining panel seam 62. Outer panel 36 may extend downward from joining panel seam 62 to locating piping 34.

Figure 22:
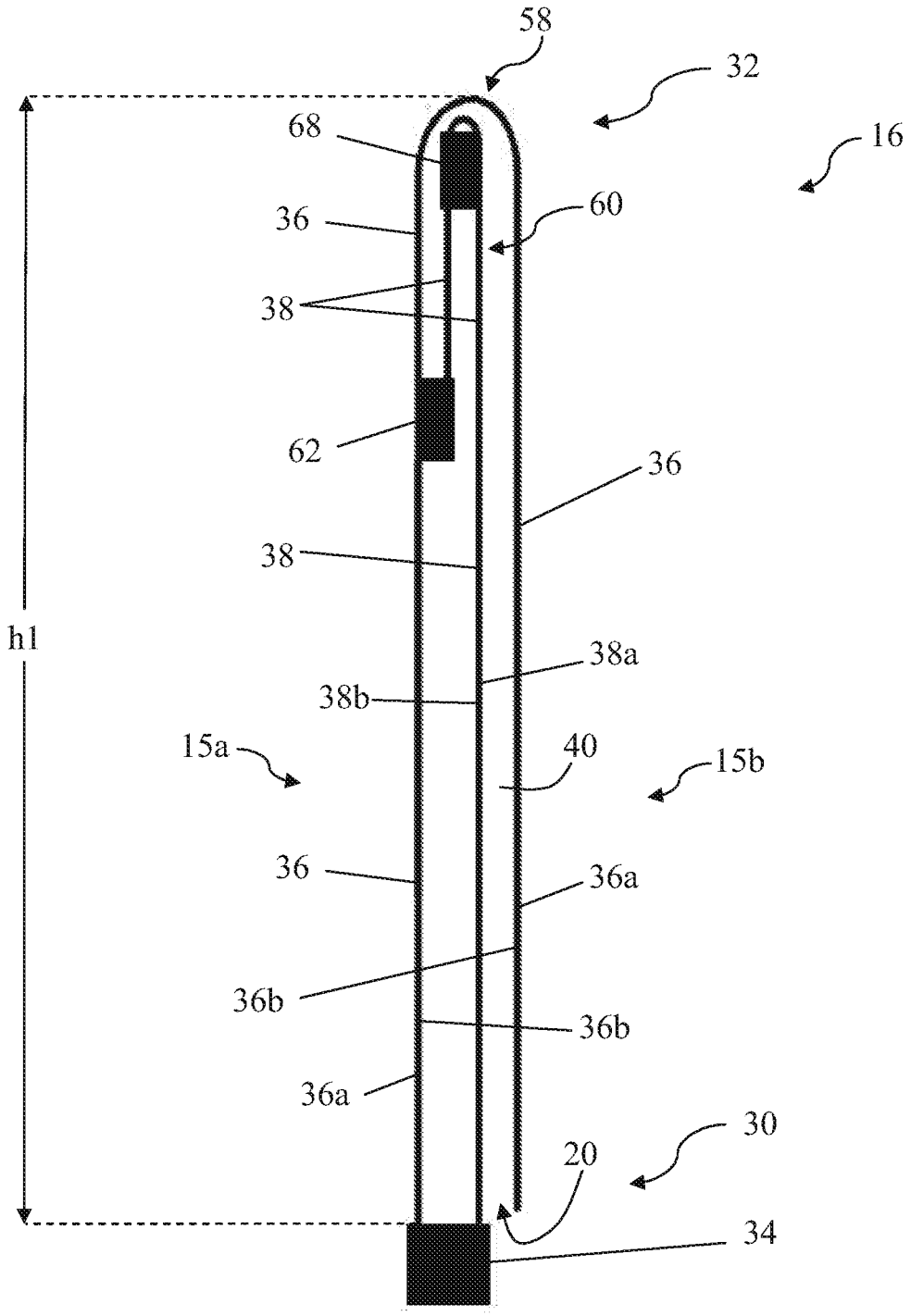
FIG. 22 is a cross sectional view of an envelope pocket taken from plane A of FIG. 21.

FIG. 22 depicts a cross sectional view taken from plane A of FIG. 21. It will be appreciated that the various panels of the exemplary envelope pocket shown are spaced apart for illustration purposes and that they might be flush against one another when the athletic garment 10 is worn by an athlete. Beginning from the bottom of the view, the outer panel 36 and inner panel 38 are shown joined together by locating piping 34. The inner panel 38 may extend from locating piping 34 generally along height h1 and may be folded over at the top portion 32 of the pocket. A top inner seam 68 may act as a locating seam for an athlete to quickly locate the top edge of the garment, which may useful in determining whether the garment is positioned correctly on a player's body. After being folded over at top seam 68, the inner panel 38 extends downward and may be joined with outer panel 36 at joining panel seam 62 along the inner waist portion 15*a* as shown. As inner panel 38 is not joined with outer panel 36 at the top edge of the garment, inner panel 38 may have an uncoupled top portion 60.

Outer panel 36 may likewise extend generally along height h1 of first envelope pocket 16. As noted above, outer panel 36 may extend from locating piping 34 and may be joined with inner panel 38 at joining panel seam 62 along the inner waist portion 15*a*. From there, outer panel 36 extends upward and folds over the uncoupled top portion 60 of inner panel 34 at top portion 32. This area of outer panel 34 may be designated as fold over portion 58. After folding over inner panel 38, the outer panel 36 may extend downward along the outer waist portion 15*b* toward bottom portion 30. Outer panel 36 may extend generally to locating piping 34. Outer panel 36 is not coupled at the bottom portion 30 along the outer waist portion 15*b*.

Outer panel 36 may have an outer panel outer surface 36*a* and an outer panel inner surface 36*b*. Inner panel 38 may have an inner panel outer surface 38*a* and an inner panel inner surface 38*b*. A pocket cavity 40 may be formed between outer panel inner surface 36*b* and inner panel outer surface 36*a*. Tennis balls and other objects may be inserted through the first pocket opening 20 and into the pocket cavity 40.

Figure 23:
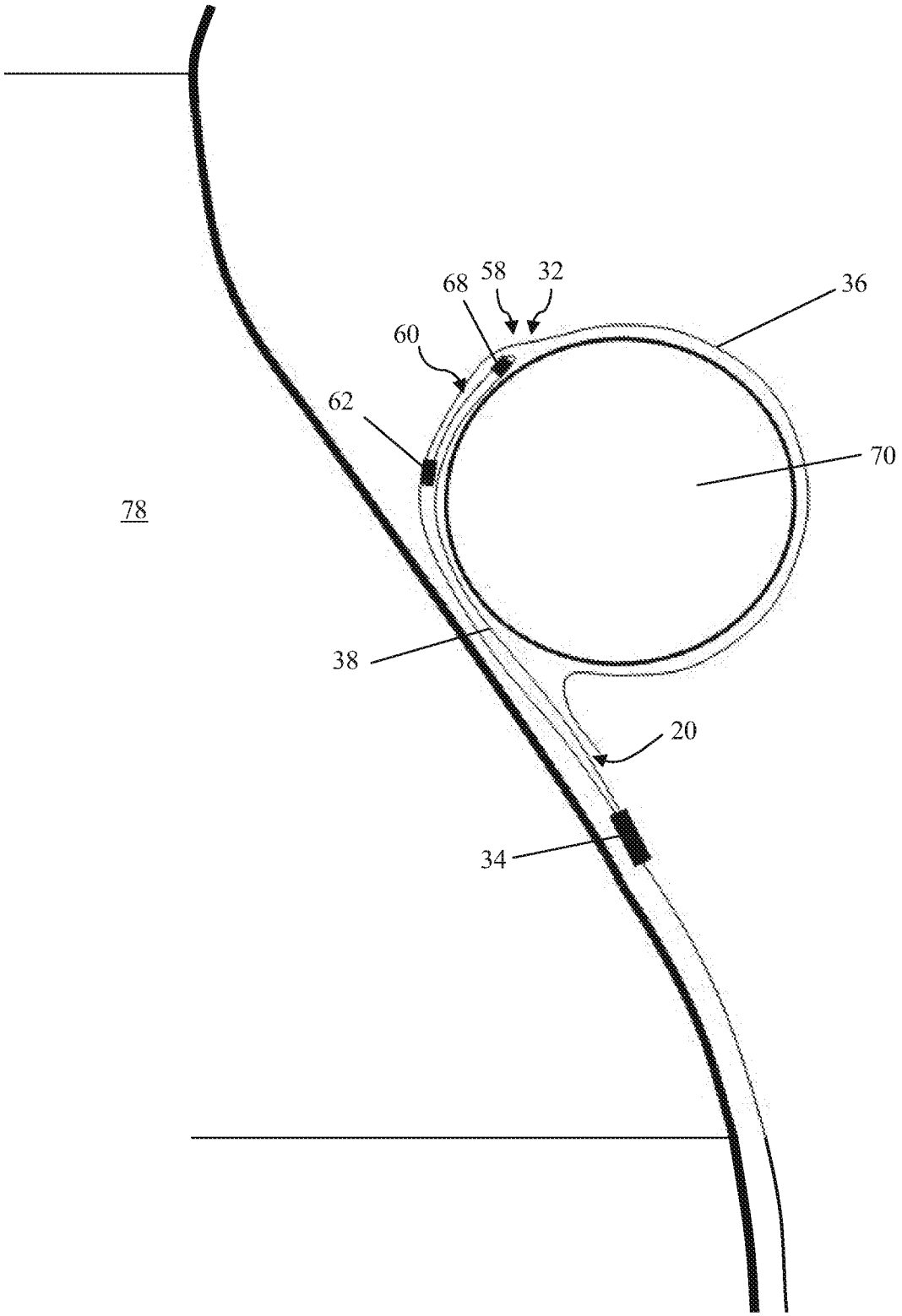
FIG. 23 is a cross sectional view of an envelope pocket taken from plane A of FIG. 21 with a tennis ball present in the envelope pocket and the lumbar curvature of an athlete depicted.

Referring now to FIG. 23, a cross sectional view of an envelope pocket 16 taken from plane A of FIG. 21 with a tennis ball 70 present in the pocket is depicted. It will be appreciated that the various panels of the exemplary envelope pocket shown are spaced apart for illustration purposes and that they might be flush against one another, tennis ball 70, and with the athlete's body when the athletic garment 10 is worn.

As shown, the inner panel 38 may have an uncoupled top portion 60 that is not coupled or attached to outer panel 36 at its end (or top seam 68); thus, the envelope pocket 12 may offer more lateral flexibility. Meaning, when a tennis ball 70 or other object is inserted into the pocket, the ball may not only be pushed upward into the pocket, but the ball may also be pushed laterally inward toward an athlete's upper buttocks/lower back region. The lateral flexibility of the envelop pocket 12 may allow for a tennis ball 70 or other object stored within the pocket to sit more flush with an athlete's body. More specifically, the lateral flexibility may allow for a ball to be inserted and placed more flush with the more laterally sloped natural contours of an athlete's lower lumbar/upper sacrum region, as opposed to say, a more vertically sloped mid-buttocks region. So, in this embodiment, not only is the compression material of the outer panel compressing the tennis ball 70 in place, the more laterally sloped contours of an athlete's body may also apply a magnitude of upward force.

Moreover, as the outer panel 36 is not coupled or attached to the inner panel 38 at top portion 32 (the outer panel 36 has a fold over portion 58 that folds over the inner panel 38), more surface area of the athletic garment 10 may be placed under tension when a tennis ball 70 is inserted into an envelope pocket 12. With more surface area of material under tension, the greater the surface area applying a compressive force on the tennis ball 70, as elastic material in tension seeks to return to its equilibrium state.

In addition, with reference still to FIG. 23, an upper buttocks/lower back region 78 of an athlete is depicted. Of course, the buttocks/lumbar curvature of individuals may vary greatly from person to person, the upper buttocks/lower back region 78 may include regions of the buttocks and lower back adjacent to where the two regions meet. The waistline region may generally be considered to be where the upper sacrum meets the lower lumbar vertebrae.

Figure 24:
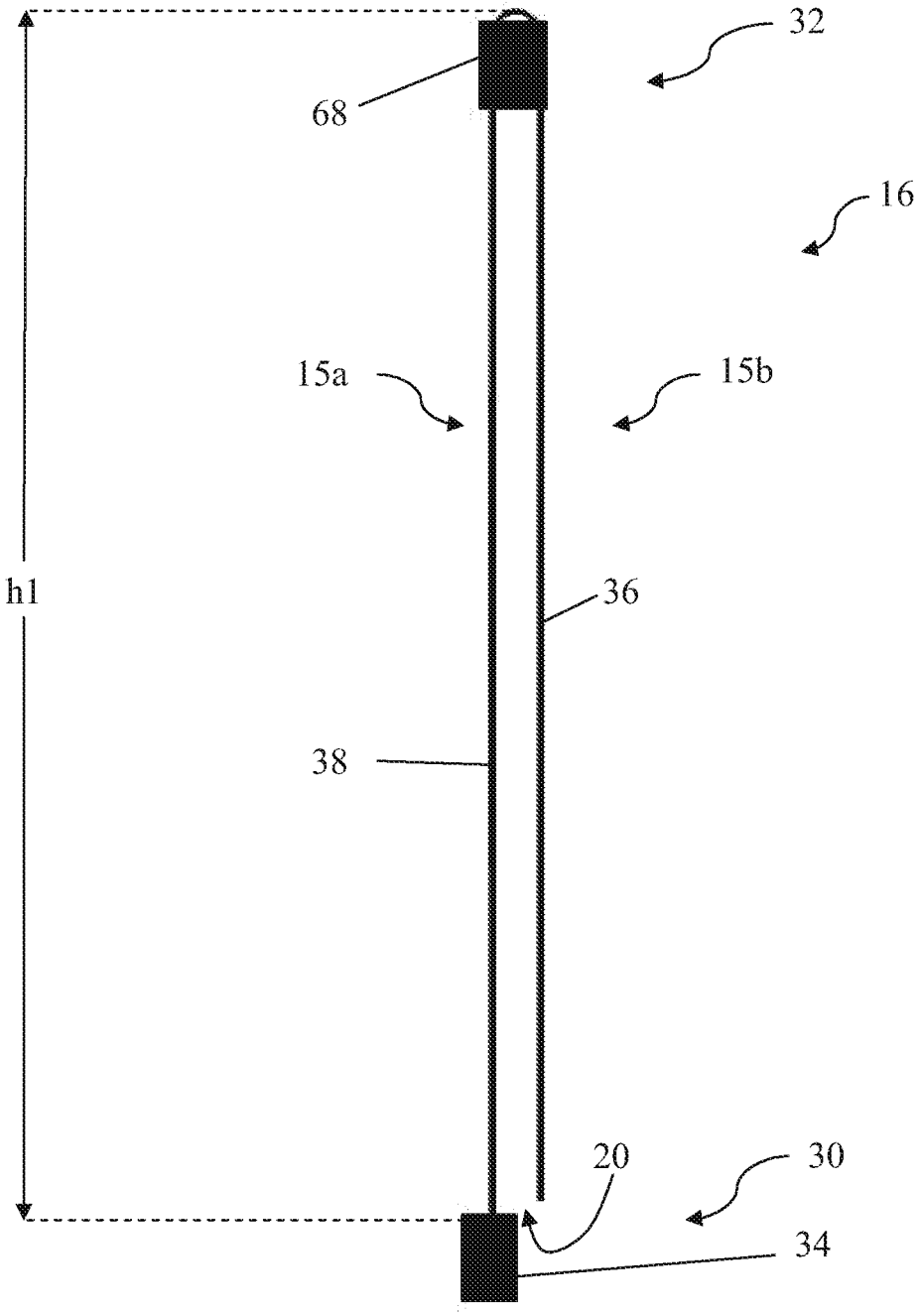
FIG. 24 is a cross sectional view of an envelope pocket showing its construction.

With reference to FIG. 24, a cross sectional view of an exemplary envelope pocket detailing its construction is shown. In this embodiment, the inner panel 38 may extend from bottom portion 30 along the height h1 of the first envelope pocket 16 until it joins with outer panel 36 at top seam 68 located generally at the top portion 32 of the pocket. The outer panel 36 may extend from top portion 32 downward to bottom portion 30. Outer panel 36 may be uncoupled at the bottom portion 30 of the pocket such that a first pocket opening 20 is formed.

In another embodiment, the outer panel 36 and inner panel 38 may be the same panel. The sole pocket panel may form the inner waist portion 15*a* of the pocket, the sole panel may then be folded over at top portion 32 (and stitched with a top seam 68), which may be useful for an athlete in locating the top edge of the garment), and then the sole panel may extend downward toward a bottom portion 30 of the pocket along the outer waist portion 15*b* of the pocket. The sole panel may be uncoupled at the bottom portion 30 of the pocket such that a first pocket opening 20 is formed.

The words used herein are understood to be words of description and not words of limitation. While various embodiments have been described, it is apparent that many variations and modifications are possible without departing from the scope and sprit of the invention as set forth in the appended claims.

What is claimed is:

1. An athletic garment, comprising:

an envelope pocket being disposed along an upper portion of the athletic garment;

the envelope pocket having an outer panel and an inner panel, the outer panel comprising of a compression material and being adapted to secure an object against the inner panel;

the envelope pocket having a height defined by a bottom portion and a top portion, and a width defined by a first seam and a second seam, the outer panel being coupled with the inner panel by the first seam and the second seam and at the top portion of the envelope pocket, forming a pocket cavity;

the outer panel having a pocket opening at the bottom portion of the envelope pocket; and wherein the first seam is positioned along a first side of the athletic garment and the second seam is positioned along a center of a rear of the athletic garment such that the width of the envelope pocket extends between the first side of the athletic garment to the center of the rear of the athletic garment.

2. The athletic garment of claim 1, wherein the upper portion of the athletic garment is a circumferential portion of the athletic garment adapted to encircle an athlete's upper buttocks/lower back region.

3. The athletic garment of claim 1, wherein a locating piping is disposed below said pocket opening, the locating piping spanning the width of the envelope pocket.

4. The athletic garment of claim 1, wherein a second envelope pocket is disposed along the upper portion of the athletic garment and is positioned adjacent to the envelope pocket, the second envelope pocket having a width defined by the second seam and a third seam positioned along a second side of the athletic garment opposite the first seam.

5. The athletic garment of claim 1, wherein the pocket opening at the bottom portion of the envelope pocket spans an entirety of the width of the envelope pocket.

6. The athletic garment of claim 1, wherein the height of the envelope pocket is a sufficient height to accommodate a tennis ball.

7. The athletic garment of claim 1, wherein the pocket opening at the bottom portion of the envelope pocket is positioned on the garment such that, when the athletic garment is worn, the pocket opening is positioned along a person's upper buttocks/lower back region.

8. The athletic garment of claim 1, wherein the outer panel and the inner panel is the same panel.

9. An athletic garment, comprising:

an envelope pocket having a height defined by a bottom portion and a top portion and a width defined by a first seam and a second seam, said envelope pocket having an outer panel being comprised of a compression material and an inner panel, said inner panel and said outer panel being coupled by said first seam and said second seam;

said envelope pocket having an inner waist portion and an outer waist portion;

said inner panel extending from said bottom portion to said top portion, said inner panel being folded over at said top portion toward said inner waist portion such that the inner panel is coupled with said outer panel by a joining panel seam positioned along said inner waist portion, said inner panel having an uncoupled top portion that is uncoupled with said outer panel; and said outer panel extending from said bottom portion to said top portion along said inner waist portion, said outer panel being configured to fold over said inner panel at said top portion such that said outer panel extends from said top portion to said bottom portion along said outer waist portion, said outer panel being uncoupled along at least one portion of said bottom portion of said outer waist portion such that said envelope pocket has a pocket opening along said bottom portion of said outer waist portion.

10. The athletic garment of claim 9, wherein said uncoupled top portion of said inner panel comprises a top seam.

11. The athletic garment of claim 10, wherein said outer panel is uncoupled along said bottom portion along an entirety of said width.

12. The athletic garment of claim 10, wherein a locating piping is disposed below said pocket opening.

13. The athletic garment of claim 10, wherein the pocket opening at the bottom portion of the envelope pocket is positioned on the athletic garment such that, when the athletic garment is worn, the pocket opening is positioned along a person's upper buttocks/lower back region.

14. An athletic garment, comprising:

an envelope pocket having a height spanning between a top portion and a bottom portion and having a width spanning between a first seam and a second seam, the envelope pocket comprising:

an outer panel formed of an elastic material;

an inner panel coupled with the outer panel at the first seam and the second seam and at the top portion of the envelope pocket thereby forming a first pocket cavity, wherein the outer panel and the inner panel define a pocket opening at the bottom portion of the envelope pocket, the pocket opening providing access to the first pocket cavity; and a flap panel formed of an elastic material and disposed between the outer panel and the inner panel, the flap panel having a height spanning between a top portion and a bottom portion and having a width spanning between a first side and a second side, the flap panel being enclosed along the bottom portion and along the first side and the second side, the flap panel and the inner panel defining a second pocket cavity, wherein the flap panel and the inner panel define an opening providing access to the second pocket cavity at the top portion of the flap panel.

15. The athletic garment of claim 14, wherein the envelope pocket is disposed along a waistband portion of the athletic garment.

16. The athletic garment of claim 14, wherein the top portion of the flap panel is positioned between the top portion and the bottom portion of the envelope pocket.

17. The athletic garment of claim 14, wherein the first side of the flap panel is coupled with the first seam and the second side of the flap panel is coupled with the second seam.

18. The athletic garment of claim 14, wherein a locating piping is disposed below the pocket opening, and wherein the bottom portion of the flap panel is coupled with the locating piping.

19. The athletic garment of claim 14, wherein the opening defined by the flap panel and the inner panel spans the width of the envelope pocket.

20. The athletic garment of claim 1, wherein the envelope pocket has a flap panel disposed between the outer panel and the inner panel, the flap panel having a height spanning between a top portion and a bottom portion and having a width spanning between a first side and a second side, the flap panel being enclosed along the bottom portion and along the first side and the second side, the flap panel and the inner panel defining a second pocket cavity, wherein the flap panel and the inner panel define an opening providing access to the second pocket cavity at the top portion of the flap panel.

* * * * *